US006273847B1

(12) United States Patent
MacLean et al.

(10) Patent No.: US 6,273,847 B1
(45) Date of Patent: Aug. 14, 2001

(54) CARTON INSERT

(75) Inventors: Chris MacLean, Pickering; H. Bruce Smith, Mississauga, both of (CA)

(73) Assignee: Molson Breweries (CA)

( * ) Notice: Subject to any disclaimer, the term of this patent is extended or adjusted under 35 U.S.C. 154(b) by 0 days.

(21) Appl. No.: 09/315,772

(22) Filed: May 20, 1999

(30) Foreign Application Priority Data

May 25, 1998 (CA) ..... 2238599

(51) Int. Cl.[7] ..... B65D 5/24; B65B 43/10
(52) U.S. Cl. ..... 493/55; 229/186; 493/162
(58) Field of Search ..... 229/5.84, 122.32, 229/122.34, 186; 206/427; 62/372, 457.6, 457.7, 457.8; 493/167, 169, 171, 174, 162, 55

(56) References Cited

U.S. PATENT DOCUMENTS

| | | | | |
|---|---|---|---|---|
| 2,150,443 | * | 3/1939 | Hoag | 229/186 |
| 2,330,262 | * | 9/1943 | Biggs | 229/186 |
| 2,391,767 | * | 12/1945 | Beerend | 229/122.34 |
| 2,512,382 | * | 6/1950 | Ringler | 493/167 |
| 2,728,200 | * | 12/1955 | Lobl | 229/122.32 |
| 3,085,479 | * | 4/1963 | Hoyrup et al. | 493/174 |
| 3,974,658 | * | 8/1976 | Starrett | 206/427 |
| 4,574,978 | | 3/1986 | Hodges . | |
| 5,307,986 | * | 5/1994 | Schuster | 229/186 |

FOREIGN PATENT DOCUMENTS

| | | | | |
|---|---|---|---|---|
| 890274 | | of 1972 | (CA) . | |
| 2645840 | * | 10/1990 | (FR) | 229/186 |
| 1 364 053 | | of 1974 | (GB) . | |
| 8003463 | * | 1/1982 | (NL) | 229/186 |

* cited by examiner

*Primary Examiner*—Gary E. Elkins
(74) *Attorney, Agent, or Firm*—Anthony J. Casella; Gerald E. Hespos

(57) ABSTRACT

An insert for a beverage carton has a floor panel, end wall panels and side wall panels. The insert is dimensioned to fit inside a beverage carton and accommodate an array of beverage containers such as bottles or cans therein. The insert is substantially waterproof.

8 Claims, 2 Drawing Sheets

CARTON INSERT

FIELD OF THE INVENTION

The present invention relates to the field of packaging. In particular, the present invention provides a waterproof insert for use with a beverage bottle carton or case, to permit the addition of ice thereto while preventing the leakage of water from the carton or case.

BACKGROUND OF THE INVENTION

Beverages such as beer are sold in cartons or cases typically holding six, twelve, fifteen, eighteen, twenty, twenty-four or twenty-eight bottles or cans per carton. The cartons are manufactured from corrugated cardboard, or a similar strong but recyclable paper product. A characteristic of corrugated cardboard and other paper products is that, unless they are specially coated, they tend to absorb water when exposed to same, and will tear easily when wet. Moreover, a box or carton made from a paper product that has not been coated for water resistance will leak if it is filled even partially with water.

A market exists, however, for a carton or case made from corrugated cardboard, or any other suitable paper product, that is capable of holding a large quantity of ice, in addition to its full complement of bottles. Such a product is useful, for instance, at picnics, or on other occasions when it is desired to provide cold beverages, but no refrigeration equipment is available. Previous attempts to provide such a product, which have met with some commercial success, have involved manufacturing a carton from a corrugated cardboard or other suitable material that has been coated with a waterproof substance such as wax, or plastic. The drawback of such an approach is that cartons or cases manufactured with such material must also be assembled in such a manner that there are no physical gaps in the box structure. This necessitates using wider, overlapping flaps on the sides and bottom of the container, and extensive amounts of glue. Moreover, the lowermost corners of cartons or cases manufactured in such a way should be reinforced, or they may leak.

The object of the present invention is to provide a liner that can be used with existing beverage cartons or cases, to permit the addition of ice thereto. Use of the liner of the present invention permits existing cartons or cases to be utilized without coating or treating the cardboard thereof for water resistance, and without requiring the employment of any special methods of manufacturing in connection with such cartons or cases.

In a broad aspect, then, the present invention relates to an insert for a beverage carton, said insert having a floor panel, end wall panels and side wall panels, and being dimensioned to fit inside a beverage carton and accommodate an array of beverage containers such as bottles or cans therein, said insert being substantially waterproof.

BRIEF DESCRIPTION OF THE DRAWINGS

In drawings that illustrate the present invention by way of example.

DETAILED DESCRIPTION

Figure 1:
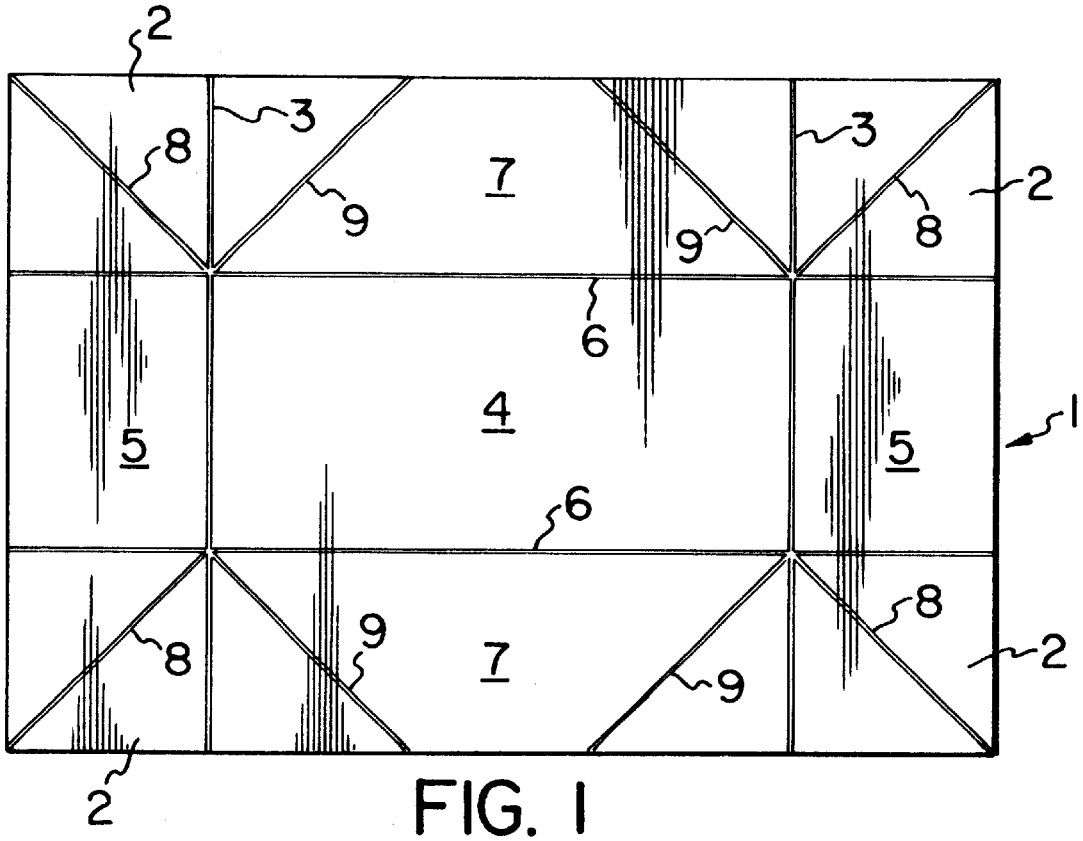
FIG. 1 is a top view of a blank for a waterproof carton insert according to the present invention.

Referring now to the drawings, a blank 1 for making the waterproof carton insert of the present invention is shown in FIG. 1. The blank 1 comprises a generally rectangular sheet of a wet strength box board, that has been coated with a waterproofing material. For instance, the box board may be clay coated, polyethylene coated, wax coated, lacquer coated or coated with any other known waterproofing material.

The corner sections 2 of the blank may be cut slightly inset from the remainder of the blank. This merely facilitates folding the blank, and the handling of the blank by packaging machinery.

The blank 1 is provided with a number of pre-creased (e.g., by embossing) fold lines, as shown in broken lines in the drawings. The fold lines include lateral fold lines 3, at each end of the floor panel 4 of the blank separating the end wall panels 5 from the floor panel. The fold lines also include longitudinal fold lines 6, separating side wall panels 7 from the floor panel. The fold lines also include corner lines 8 that extend diagonally on corner sections 2, from the corners of the floor panel 4 to the corners of the blank 1. Lastly, the fold lines include side wall fold lines 9, from each corner of the floor panel 4 to an outer edge of a side wall 7.

Figure 2:
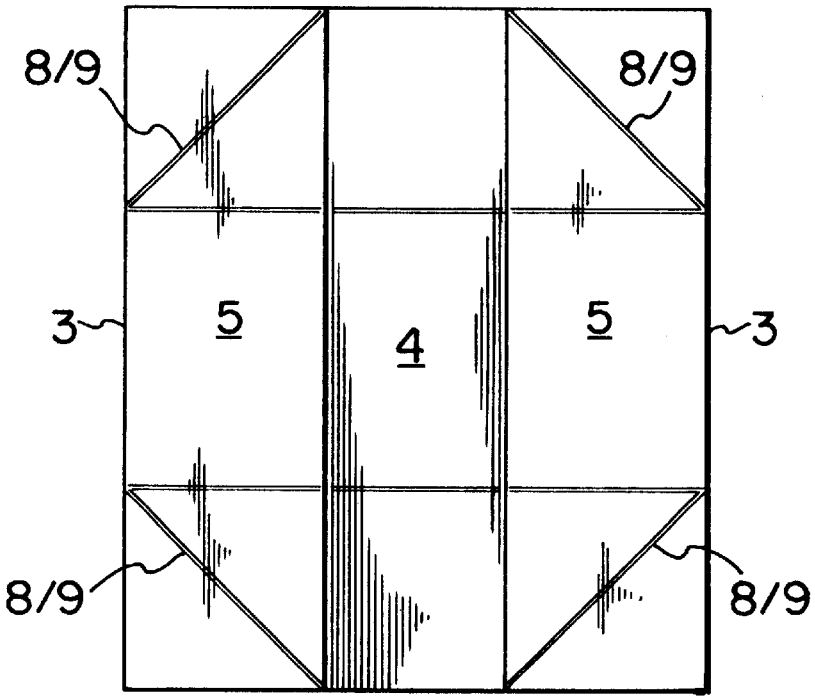
FIG. 2 is a top view of the blank of FIG. 1 showing its first folding operation.
Figure 3:
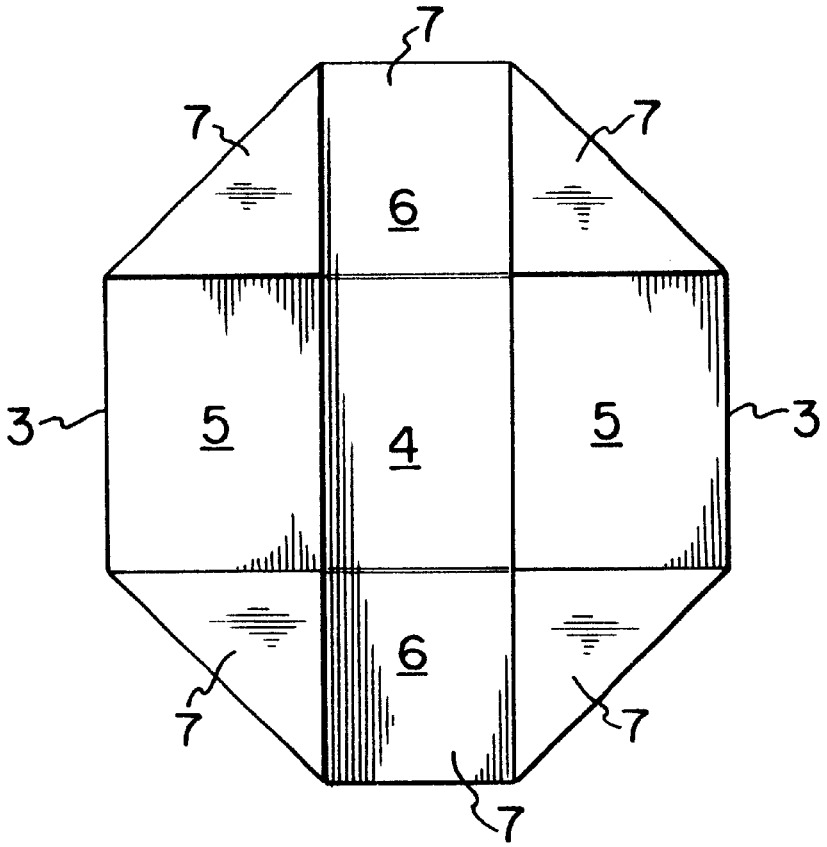
FIG. 3 is a top view of the blank of FIGS. 1 and 2, showing its second folding operation.

To construct the blank of FIG. 1 into an insert for use in a carton, first the end wall panels 5 are folded over onto floor panel 4 along lateral fold lines 3, as shown in FIG. 2. Then, as shown in FIG. 3, the corner sections are folded diagonally in two, along superimposed corner fold lines 8 and side fold lines 9. Glue is applied when this fold is made, to keep the corner from opening up.

Figure 4:
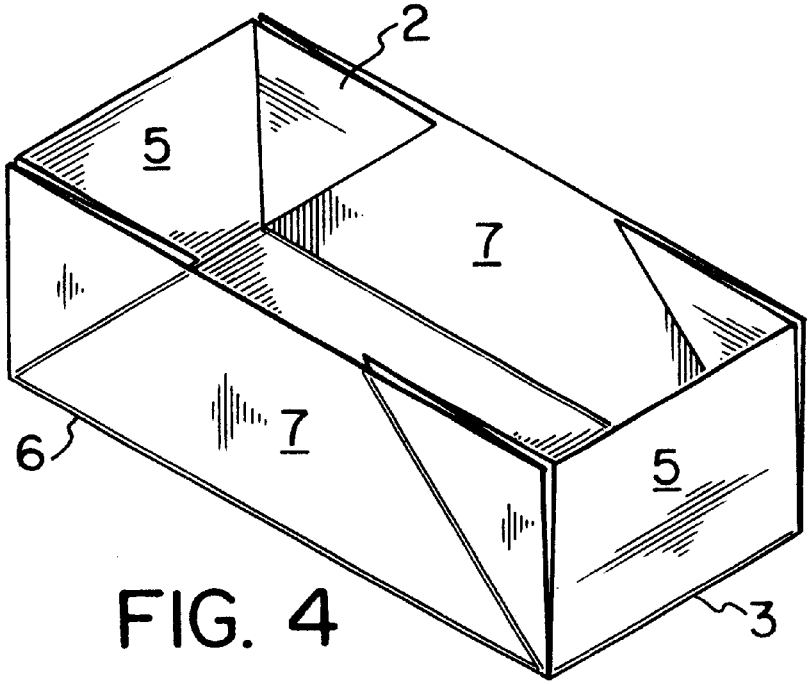
FIG. 4 is a perspective view of the blank of FIGS. 1–3 in an assembled and erected state.

As shown in FIG. 4, the insert is erected by folding the side wall panels upwardly to a 90° angle to the floor panel 2. Simultaneously, the over-folded end wall panels are unfolded upwardly, also to a 90° angle to the floor panel. This forms the generally open-box shaped insert shown in FIG. 4, which can be inserted into a top-load carton, after when any necessary dividers, and bottles of beverage can be inserted into the carton, within the insert of the present invention.

Alternatively, an array of filled beverage bottles can be loaded into the insert of FIG. 4 from the top, and then the filled insert slid into an end-load carton.

It will, moreover, be understood that the described sequence of folding may be substantially reversed. That is, the side panels may first be folded over, then the corners formed, and then the ends and sides erected. This is possible if the side panels do not overlap when folded over, e.g., for a wide carton like a four-by-six twenty-four bottle carton.

It is to be understood that the examples described above are not meant to limit the scope of the present invention. It is expected that numerous variants will be obvious to the person skilled in the field of package design without any departure from the spirit of the invention. The appended claims, properly construed, form the only limitation upon the scope of the invention.

The embodiments of the invention in which an exclusive property or privilege is claimed are defined as follows:

1. A method of manufacturing an insert for a beverage carton, the insert being dimensioned to fit inside the beverage carton and to accommodate an array of beverage containers therein, said insert being substantially waterproof, said method comprising the steps of:

providing a substantially rectangular blank having opposed side edges and opposed end edges meeting said side edges at corners of said blank, said blank having fold lines impressed therein and defining a substantially rectangular floor panel defined by parallel side fold lines and parallel end fold lines, said end fold lines meeting said side fold lines at floor panel corners, end wall panels extending from said end fold lines, side wall panels extending from said side fold lines, and corner sections extending between said side wall panels and said end wall panels, each said corner section being provided with a diagonal fold line impressed therein and extending from one said corner of said floor panel to one said corner of said blank;

folding said end wall panels inwardly over said floor panel along the end fold lines;

folding said corner sections diagonally in half along the respective diagonal fold lines, and adhesively affixing said corner sections in a folded state; and folding said side wall panels upwardly to a position normal to said floor panel, whereby an erected insert is formed.

2. The method of claim 1, wherein said beverage carton has an interior with a bottom surface, said step of providing a blank comprising providing a blank such that said floor panel is of a size selected to occupy substantially the entire bottom surface of the interior of said beverage carton.

3. The method of claim 2, wherein said end wall panels and said side wall panels extend from said floor panel distances selected to accommodate a quantity of ice packed around said beverage containers when said insert has been manufactured, and to catch water formed from melting of said ice.

4. The method of claim 3, wherein said end wall panels and said side wall panels are dimensioned such that on the insert manufactured from the blank, said end wall panels and said side wall panels are as tall as major portions of said beverage containers.

5. The method of claim 4, wherein the step of providing a substantially rectangular blank comprises providing a blank made from a recyclable material selected from the group consisting of paper products, plastics and aluminum.

6. The method of claim 5, wherein the step of providing a substantially rectangular blank comprises providing a blank made from cardboard coated with a waterproof coating on a surface that will define an interior surface of the insert manufactured from the blank.

7. The method of claim 5, wherein the step of providing a substantially rectangular blank comprises providing a blank made from box board coated with a waterproof coating selected from the group consisting of clay coating, plastic coating, wax coating and lacquer coating.

8. The method of claim 1, further comprising inserting the insert into the beverage carton.

* * * * *